US011559963B2

(12) United States Patent
Kumar et al.

(10) Patent No.: US 11,559,963 B2
(45) Date of Patent: Jan. 24, 2023

(54) MULTILAYER CREPING BELT HAVING CONNECTED OPENINGS, METHODS OF MAKING PAPER PRODUCTS USING SUCH A CREPING BELT, AND RELATED PAPER PRODUCTS

(71) Applicant: GPCP IP Holdings LLC, Atlanta, GA (US)

(72) Inventors: Vipul Kumar, Appleton, WI (US); Tianyan Hartlep, Appleton, WI (US); Farminder Anand, Painesville, OH (US); Xiaolin Fan, Appleton, WI (US); Daniel Hue Ming Sze, Appleton, WI (US); Taiye Philips Oriaran, Appleton, WI (US); Brian J. Schuh, Appleton, WI (US); Dean J. Baumgartner, Bonduel, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 206 days.

(21) Appl. No.: 17/004,906

(22) Filed: Aug. 27, 2020

(65) Prior Publication Data

US 2021/0070005 A1 Mar. 11, 2021

Related U.S. Application Data

(60) Provisional application No. 62/897,842, filed on Sep. 9, 2019.

(51) Int. Cl.

*B31F 1/16* (2006.01)
*D21F 11/14* (2006.01)

(52) U.S. Cl.

CPC ..... *B31F 1/16* (2013.01); *D21F 11/145* (2013.01)

(58) Field of Classification Search

CPC .... D21H 27/002; D21H 27/00; D21H 27/004; D21H 27/005; B31F 1/16; B31F 1/126; D21F 11/145; D21F 11/006; D21F 1/0036

See application file for complete search history.

(56) References Cited

U.S. PATENT DOCUMENTS

| | | | |
|---|---|---|---|
| 7,118,647 | B2 | 10/2006 | Cabell et al. |
| 8,152,957 | B2 | 4/2012 | Edwards et al. |
| 8,394,239 | B2 | 3/2013 | Eagles et al. |

(Continued)

FOREIGN PATENT DOCUMENTS

| | | | | |
|---|---|---|---|---|
| CA | 2962093 | A1 * | 3/2016 | ..... D21F 1/0036 |
| EP | 2752289 | B1 * | 2/2018 | ..... B31F 1/122 |

(Continued)

OTHER PUBLICATIONS

International Search Report and Written Opinion dated Nov. 19, 2020, issued in corresponding International Application No. PCT/IB2020/058103.

*Primary Examiner* — Jose A Fortuna

(57) ABSTRACT

An absorbent sheet made by a process that includes the steps of forming a nascent web from an aqueous papermaking furnish, and creping the nascent web on a multilayer belt that includes (i) a first layer made from a polymeric material having a plurality of overlapping openings, and (ii) a second layer attached to the first layer, with the nascent web being deposited onto a surface of the first layer. The absorbent sheet includes a plurality of hollow domed regions projecting from a side of the absorbent sheet.

9 Claims, 8 Drawing Sheets

(56) References Cited

U.S. PATENT DOCUMENTS

| | | | | |
|---|---|---|---|---|
| 8,968,516 | B2 * | 3/2015 | Super | D21F 1/0027 162/111 |
| 9,017,517 | B2 * | 4/2015 | Super | B31F 1/126 162/111 |
| 9,388,534 | B2 * | 7/2016 | Super | B31F 1/16 |
| 9,863,095 | B2 * | 1/2018 | Sze | D21H 27/007 |
| 9,873,980 | B2 * | 1/2018 | Eagles | D21F 1/0036 |
| 9,957,665 | B2 * | 5/2018 | Eagles | D21F 1/0036 |
| 10,167,595 | B2 * | 1/2019 | Sze | D21H 11/04 |
| 10,415,186 | B2 * | 9/2019 | Eagles | D21F 7/083 |
| 10,731,301 | B2 * | 8/2020 | Sze | D21H 27/007 |
| 10,961,660 | B2 * | 3/2021 | Eagles | D21F 1/0036 |
| 2010/0186913 | A1 | 7/2010 | Super et al. | |
| 2016/0009063 | A1 | 1/2016 | Calving, Jr. | |
| 2016/0090692 | A1 | 3/2016 | Eagles et al. | |
| 2016/0090693 | A1 * | 3/2016 | Eagles | D21F 11/006 162/348 |
| 2016/0090698 | A1 | 3/2016 | Sze et al. | |
| 2016/0355982 | A1 | 12/2016 | Sze et al. | |
| 2018/0044860 | A1 * | 2/2018 | Sze | D21H 11/04 |
| 2018/0105984 | A1 * | 4/2018 | Eagles | D21F 7/083 |
| 2019/0078268 | A1 * | 3/2019 | Sze | D21F 11/006 |
| 2019/0360154 | A1 * | 11/2019 | Eagles | D21F 7/083 |
| 2021/0070005 | A1 * | 3/2021 | Kumar | D21F 11/006 |
| 2021/0087748 | A1 * | 3/2021 | Sze | D21F 7/083 |
| 2022/0112665 | A1 * | 4/2022 | Schuh | D21H 27/02 |

FOREIGN PATENT DOCUMENTS

| | | | | |
|---|---|---|---|---|
| EP | 3348708 | A1 | 7/2018 | |
| ES | 2664608 | T3 * | 4/2018 | B31F 1/122 |
| JP | 2021001428 | A * | 1/2021 | D21F 1/0036 |
| JP | 2022009647 | A * | 1/2022 | D21F 1/00 |
| JP | 7075456 | B2 * | 5/2022 | D21F 1/0036 |
| KR | 20220055452 | A * | 5/2022 | B31F 1/126 |
| WO | 2004033793 | A2 | 4/2004 | |
| WO | 2006113025 | A2 | 10/2006 | |
| WO | WO-2016049405 | A1 * | 3/2016 | D21F 1/00 |
| WO | WO-2016049475 | A1 * | 3/2016 | D21F 1/0036 |
| WO | WO-2016049546 | A1 * | 3/2016 | B31F 1/16 |
| WO | WO-2021059085 | A1 * | 4/2021 | B32B 15/06 |

* cited by examiner

MULTILAYER CREPING BELT HAVING CONNECTED OPENINGS, METHODS OF MAKING PAPER PRODUCTS USING SUCH A CREPING BELT, AND RELATED PAPER PRODUCTS

CROSS REFERENCE TO RELATED APPLICATION

This application is based on U.S. Provisional Patent Application No. 62/897,842, filed Sep. 9, 2019, which is hereby incorporated by reference in its entirety.

BACKGROUND

Field of the Invention

Our invention relates to a multilayer belt for creping a cellulosic web in a paper making process. The multilayer creping belt has connected openings. Our invention also relates to methods of making paper products using such a multilayer belt. Our invention still further relates to paper products having exceptional properties, and made using such a multilayer belt.

Background of the Invention

Processes for making paper products, such as tissues and towels, are well known. In such processes, an aqueous nascent web is initially formed from a paper making furnish. The nascent web is dewatered using, for example, a belt-structure made from polymeric material, usually in the form of a press fabric. In some papermaking processes, after dewatering, a shape or three dimensional texture is imparted to the web, with the web thereby being referred to as a structured sheet. One manner of imparting a shape to the web involves the use of a creping operation while the web is still in a semi-solid, moldable state. Such an operation uses a creping structure, usually in the form of a structuring fabric or belt. The creping operation occurs under pressure in a creping nip, with the web being forced into openings in the creping structure in the nip. Subsequent to the creping operation, a vacuum may also be used to further draw the web into the openings in the creping structure. After the shaping operation(s) is complete, the web is dried to substantially remove any remaining water using well-known equipment, for example, a Yankee dryer.

There are different configurations of structuring fabrics and belts known in the art. Specific examples of structuring fabrics and belts that can be used for creping in a paper making process can be seen in U.S. Pat. No. 8,152,957 and U.S. Patent Application Publication Nos. 2010/0186913, 2016/0090692, 2016/0009063, and 2016/0090698, which are all incorporated herein by reference in their entireties. In particular, U.S. Patent Application Pub. Nos. 2016/0090692, 2016/0009063, and 2016/0090698 disclose creping belts that have a multilayer structure with a plurality of openings in a top layer of the belts. During a creping operation with the multilayer belts, the web is drawn into the openings to impart structure to the final products of the paper making process. The openings in the top layer of the belts are formed, for example, by laser drilling or mechanical punching. As disclosed in U.S. Patent Application Pub. 2016/0090698, in particular, the multilayer belt disclosed therein is capable of producing paper products having outstanding combinations of properties.

In all of the belts disclosed in U.S. Patent Application Pub. Nos. 2016/0090692, 2016/009063, and 2016/0090698, however, the openings in the top layer are separated from each other by some distance along the surface of the top layer that contacts the web. That is, there are spaces along the surface of the top layer between the outer perimeters of each of the openings, and each opening is separated from all of the other openings by a portion having the full thickness of the top layer. Such distances between the openings ensure that a large amount of the material of the top layer remains, even after the openings are formed, and thus, there is a sufficient surface area on the side of the top layer that is positioned adjacent to the bottom layer for an adhesive structure to be used to securely attach the top and bottom layers. But, the distances between the openings along the contact surface also results in dome structures in the paper products formed using the multilayer belt being separated from each other. The separated domes in turn have effects on the properties of the paper products made using the multilayer belt.

SUMMARY OF THE INVENTION

According to one aspect, our invention provides a creping belt having connected openings, the creping belt being useable in a paper making process. In another aspect, our invention relates to papermaking processes that use a belt having a multi-layer structure having connected openings. Our invention further relates to paper products having exceptional properties, with the paper products being formed using a multilayer creping belt having connected openings.

DETAILED DESCRIPTION OF THE INVENTION

Figure 1:
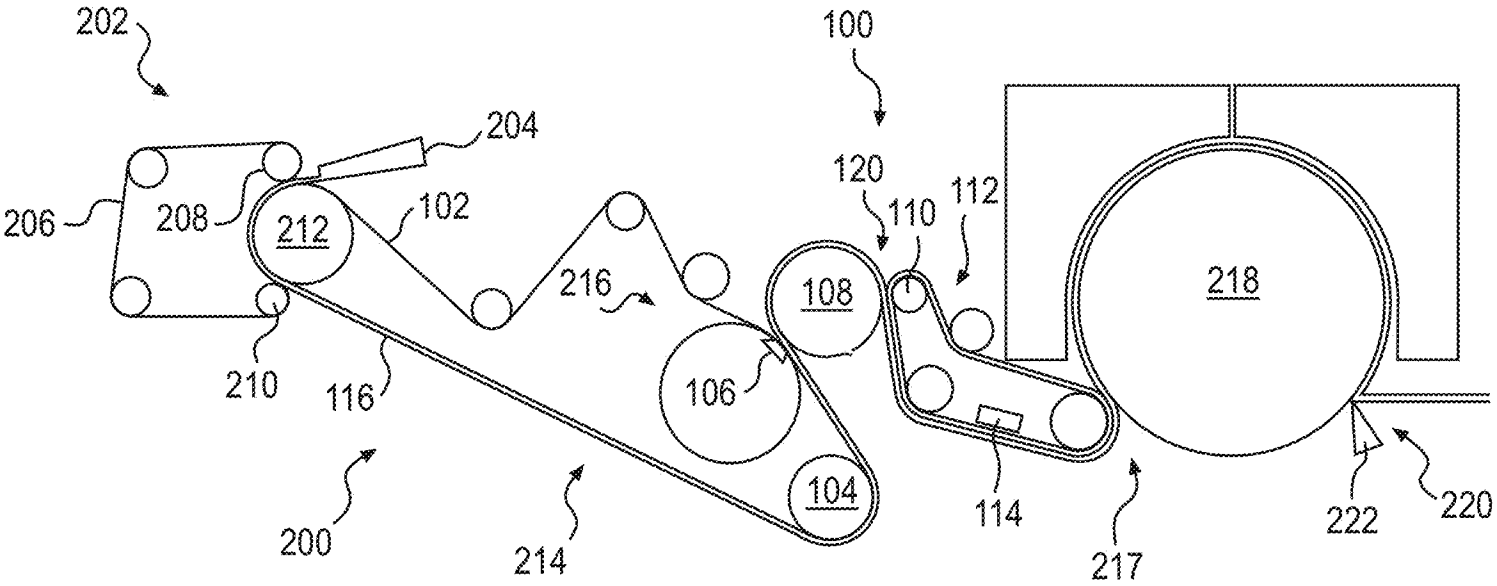
FIG. 1 is a schematic view of a paper making machine configuration that can be used in conjunction with the present invention.

In one aspect, our invention relates to a creping belt having connected openings, the creping belt being useable in a paper making process. In another aspect, our invention relates to papermaking processes that use a belt having a multi-layer structure having connected openings. Our invention further relates to paper products having exceptional properties, with the paper products being formed using a multilayer creping belt having connected openings.

The term "paper products" as used herein encompasses any product incorporating papermaking fiber having cellulose as a major constituent. This would include, for example, products marketed as paper towels, toilet paper, facial tissues, etc. Papermaking fibers include virgin pulps or recycle (secondary) cellulosic fibers, or fiber mixes comprising cellulosic fibers. Wood fibers include, for example, those obtained from deciduous and coniferous trees, including softwood fibers, such as northern and southern softwood kraft fibers, and hardwood fibers, such as *eucalyptus*, maple, birch, aspen, or the like. Examples of fibers suitable for making the webs of our invention include non-wood fibers, such as cotton fibers or cotton derivatives, abaca, kenaf, sabai grass, flax, esparto grass, straw, jute hemp, bagasse, milkweed floss fibers, and pineapple leaf fibers. "Furnishes" and like terminology refers to aqueous compositions including papermaking fibers, and, optionally, wet strength resins, debonders, and the like, for making paper products.

As used herein, the initial fiber and liquid mixture that is dried to a finished product in a papermaking process will be referred to as a "web" and/or a "nascent web." The dried, single-ply product from a papermaking process will be referred to as a "basesheet." Further, the product of a papermaking process may be referred to as an "absorbent sheet." In this regard, an absorbent sheet may be the same as a single basesheet. Alternatively, an absorbent sheet may include a plurality of basesheets, as in a multi-ply structure. Further, an absorbent sheet may have undergone additional processing after being dried in the initial basesheet forming process, e.g., embossing.

When describing our invention herein, the terms "machine direction" (MD) and "cross machine direction" (CD) will be used in accordance with their well understood meaning in the art. That is, the MD of a fabric or other structure refers to the direction that the structure moves on a papermaking machine in a papermaking process, while CD refers to a direction crossing the MD of the structure. Similarly, when referencing paper products, the MD of the paper product refers to the direction on the product that the product moved on the papermaking machine in the papermaking process, and the CD of the product refers to the direction crossing the MD of the product.

Papermaking Machines

Processes utilizing the inventive belts and making the inventive products may involve compactly dewatering papermaking furnishes having a random distribution of fibers so as to form a semi-solid web, and then belt creping the web so as to redistribute the fibers and shape the web in order to achieve paper products with desired properties. These steps of papermaking processes can be conducted on papermaking machines having many different configurations. Two examples of such papermaking machines will now be described.

FIG. 1 shows a first example of a papermaking machine 200. The papermaking machine 200 includes a press section 100 in which a creping operation is conducted. Upstream of the press section 100 is a forming section 202, which, in the case of papermaking machine 200, is referred to in the art as a crescent former. The forming section 202 includes headbox 204 that deposits a furnish on a forming wire 206 supported by rolls 208 and 210, thereby initially forming the papermaking web. The forming section 202 also includes a forming roll 212 that supports a papermaking felt 102 such that web 116 is also formed directly on the papermaking felt 102. The felt run 214 extends to a shoe press section 216 wherein the moist web is deposited on a backing roll 108, with the web 116 being wet-pressed concurrently with the transfer to the backing roll 108.

An example of an alternative to the configuration of papermaking machine 200 includes a twin-wire forming section, instead of the crescent forming section 202. In such a configuration, downstream of the twin-wire forming section, the rest of the components of such a papermaking machine may be configured and arranged in a similar manner to that of papermaking machine 200. An example of a papermaking machine with a twin-wire forming section can be seen in the aforementioned U.S. Patent Application Pub. No. 2010/0186913. Still further examples of alternative forming sections that can be used in a paper making machine include a C-wrap twin wire former, an S-wrap twin wire former, or a suction breast roll former. Those skilled in the art will recognize how these, or even still further alternative forming sections, can be integrated into a papermaking machine.

The web 116 is transferred onto creping belt 112 in a belt crepe nip 120, and then vacuum drawn by vacuum box 114, as will be described in more detail below. After this creping operation, the web 116 is deposited on Yankee dryer 218 in another press nip 217 using a creping adhesive. The transfer to the Yankee dryer 218 may occur, for example, with about 4% to about 40% pressurized contact area between the web 116 and the Yankee surface at a pressure of about 250 pounds per linear inch (PLI) to about 350 PLI (about 43.8 kN/meter to about 61.3 kN/meter). The transfer at press nip 217 may occur at a web consistency, for example, from about 25% to about 70%. Note that "consistency," as used herein, refers to the percentage of solids of a nascent web, for example, calculated on a bone dry basis. At about 25% to about 70% consistency, it is sometimes difficult to adhere the web 116 to the surface of the Yankee dryer 218 firmly enough so as to thoroughly remove the web from the creping belt 112. In order to increase the adhesion between the web 116 and the surface of the Yankee dryer 218, an adhesive may be applied to the surface of the Yankee dryer 218. The adhesive can allow for high velocity operation of the system and high jet velocity impingement air drying, and also allow for subsequent peeling of the web 116 from the Yankee dryer 218. An example of such an adhesive is a poly(vinyl alcohol)/polyamide adhesive composition, with an example application rate of this adhesive being at a rate of less than about 40 $mg/m^2$ of sheet. Those skilled in the art, however, will recognize the wide variety of alternative adhesives, and further, quantities of adhesives, that may be used to facilitate the transfer of the web 116 to the Yankee dryer 218.

The web 116 is dried on Yankee dryer 218, which is a heated cylinder and by high jet velocity impingement air in the Yankee hood around the Yankee dryer 218. As the Yankee dryer 218 rotates, the web 116 is peeled from the Yankee dryer 218 at position 220. The web 116 may then be subsequently wound on a take-up reel (not shown). The reel may be operated faster than the Yankee dryer 218 at steady-state in order to impart a further crepe to the web 116. Optionally, a creping doctor blade 222 may be used to conventionally dry-crepe the web 116. In any event, a cleaning doctor may be mounted for intermittent engagement and used to control build up.

Figure 2:
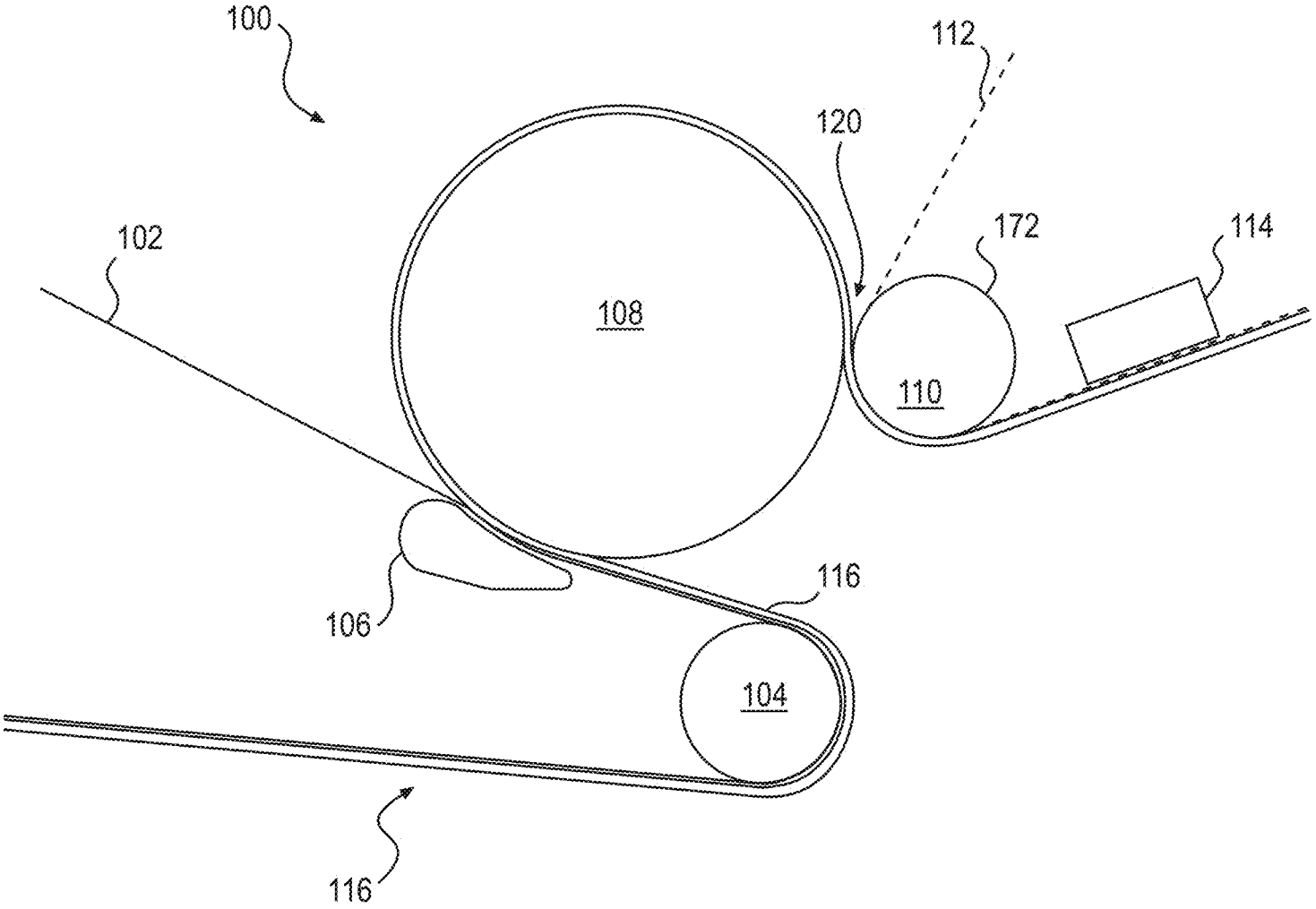
FIG. 2 is a schematic view illustrating the wet-press transfer and belt creping section of the papermaking machine shown in FIG. 1.

FIG. 2 shows details of the press section 100 where creping occurs. The press section 100 includes a papermaking felt 102, a suction roll 104, a press shoe 106, and a backing roll 108. The backing roll 108 may optionally be heated, for example, by steam. The press section 100 also includes a creping roll 110, the creping belt 112, and the vacuum box 114. The creping belt 112 may be configured as the inventive multilayer belt that will described in detail below.

In a creping nip 120, the web 116 is transferred onto the top side of the creping belt 112. The creping nip 120 is defined between the backing roll 108 and the creping belt 112, with the creping belt 112 being pressed against the backing roll 108 by the surface 172 of the creping roll 110. In this transfer at the creping nip 120, the cellulosic fibers of the web 116 are repositioned and oriented, as will be described in detail below. After the web 116 is transferred onto the creping belt 112, a vacuum box 114 may be used to apply suction to the web 116 in order to at least partially draw out minute folds. The applied suction may also aid in drawing the web 116 into openings in the creping belt 112, thereby further shaping the web 116. Further details of this shaping of the web 116 will be described below.

The creping nip 120 generally extends over a belt creping nip distance or width of anywhere from, for example, about ⅛ in. to about 2 in. (about 3.18 mm to about 50.8 mm), more specifically, about 0.5 in. to about 2 in. (about 12.7 mm to about 50.8 mm). The nip pressure in creping nip 120 arises from the loading between creping roll 110 and backing roll 108. The creping pressure is, generally, from about 20 to about 100 PLI (about 3.5 kN/meter to about 17.5 kN/meter), more specifically, about 40 PLI to about 70 PLI (about 7 kN/meter to about 12.25 kN/meter). While a minimum pressure in the creping nip 120 of 10 PLI (1.75 kN/meter) or 20 PLI (3.5 kN/meter) is often necessary, one of skill in the art will appreciate that, in a commercial machine, the maximum pressure may be as high as possible, limited only by the particular machinery employed. Thus, pressures in excess of 100 PLI (17.5 kN/meter), 500 PLI (87.5 kN/meter), or 1000 PLI (175 kN/meter) or more may be used, if practical, and provided a velocity delta can be maintained.

In some embodiments, it may by desirable to restructure the interfiber characteristics of the web 116, while, in other cases, it may be desired to influence properties only in the plane of the web 116. The creping nip parameters can influence the distribution of fibers in the web 116 in a variety of directions, including inducing changes in the z-direction (i.e., the bulk of the web 116), as well as in the MD and CD. In any case, the transfer from the creping belt 112 is at high impact in that the creping belt 112 is traveling slower than the web 116 is traveling off of the backing roll 108, and a significant velocity change occurs. In this regard, the degree of creping is often referred to as the creping ratio, with the ratio being calculated as:

$$\text{Creping Ratio } (\%) = S_1/S_2 - 1$$

where $S_1$ is the speed of the backing roll 108 and $S_2$ is the speed of the creping belt 112. Typically, the web 116 is creped at a ratio of about 5% to about 60%. In fact, high degrees of crepe can be employed, approaching or even exceeding 100%.

It should once again be noted that the papermaking machine depicted in FIG. 1 is merely an example of the possible configurations that can be used with the invention described herein. Further examples include those described in the aforementioned U.S. Patent Application Pub. No. 2010/0186913.

Multilayer Creping Belts

Our invention is directed, in part, to a multilayer belt that can be used for the creping operations in papermaking machines such as those described above. As discussed above, such multilayer creping belts are described in U.S. Patent Application Pub. Nos. 2016/0090692, 2016/009063, and 2016/0090698 ("multilayer belt applications"). As will be evident from the disclosure in those patent application publications, the structure of a multilayer creping belt provides many advantageous characteristics that are particularly suited for creping operations. In particular, the multilayer creping belt provides all of the desirable aspects of a polymeric creping belt by providing different properties to the belt in different layers of the overall belt structure. Specifically, the multilayer belt includes a top layer made from a polymeric material that allows for openings with diverse shapes and sizes to be formed in the layer. Meanwhile, the bottom layer of the multilayer belt is formed from a material that provides strength and durability to the belt. By providing the strength and durability in the bottom layer, the top polymeric layer can be provided with larger openings than could otherwise be provided in a polymeric belt because the top layer need not contribute to the strength and durability of the belt.

A multilayer creping belt as described herein includes at least two layers. As used herein, a "layer" is a continuous, distinct part of the belt structure that is physically separated from another continuous, distinct layer in the belt structure. An example of two layers in a multilayer belt according to the invention is a polymeric layer that is bonded with an adhesive to the fabric layer. Notably, a layer, as defined herein, could include a structure having another structure substantially embedded therein. For example, U.S. Pat. No. 7,118,647 describes a papermaking belt structure wherein a layer that is made from photosensitive resin has a reinforcing element embedded in the resin. This photosensitive resin with a reinforcing element is a layer in the terms of the present invention. At the same time, however, the photosensitive resin with the reinforcing element does not constitute a "multilayer" structure as used in the present application, as the photosensitive resin with the reinforcing element are not two continuous, distinct parts of the belt structure that are physically separated from each other.

It should be noted that the "top" or "sheet" or "Yankee" side of the creping belt refers to the side of the belt on which the web is deposited for the creping operation. Hence, the "top layer" is the portion of the multilayer belt that forms the surface onto which the cellulosic web is shaped in the creping operation. The "bottom" or "air" ("machine") side of the creping belt, as used herein, refers to the opposite side of the belt, i.e., the side that faces and contacts the processing equipment such as the creping roll and the vacuum box. And, accordingly, the "bottom layer" provides the bottom (air) side surface.

One of the functions of the top layer of a multilayer belt according to the invention is to provide a structure into which openings can be formed, with the openings passing through the layer from one side of the layer to the other, and with the openings imparting dome shapes to the web in a papermaking process. The top layer does not need to impart any strength and durability to the belt structure, per se, as these properties will be provided primarily by the bottom layer, as described below. Further, the openings in the top layer need not be configured to prevent fibers from being pulled through the top layer in the papermaking process, as this will also be achieved by the bottom layer, as will also be described below.

In some embodiments of the invention, the top layer of our multilayer belt is made from an extruded flexible thermoplastic material. In this regard, there is no particular limitation on the types of thermoplastic materials that can be used to form the top layer, as long as the material generally imparts the properties such as friction (e.g., between the paper forming web and the belt), compressibility, and tensile strength for the top layer described herein. And, as will be apparent to those skilled in the art from the disclosure herein, there are numerous possible flexible thermoplastic materials that can be used that will provide substantially similar properties to the thermoplastics specifically discussed herein. It should also be noted that the term "thermoplastic material" as used herein is intended to include thermoplastic elastomers, e.g., rubber materials. It should be further noted that the thermoplastic material could include either thermoplastic materials in fiber form (e.g., chopped polyester fiber) or non-plastic additives, such as those found in composite materials.

A thermoplastic top layer can be made by any suitable technique, for example, molding, extruding, thermoforming, etc. Notably, the thermoplastic top layer can be made from a plurality of sections that are joined together, for example, side to side in a spiral fashion as described in U.S. Pat. No. 8,394,239, the disclosure of which is incorporated by reference in its entirety. Moreover, the thermoplastic top layer can be made to any particular required length, and can be tailored to the path length required for any specific papermaking machine configuration.

In specific embodiments, the material used to form the top layer of the multilayer belt is polyurethane. As an alternative to polyurethane, another thermoplastic that may be used to form the top layer in other embodiments of the invention is sold under the name HYTREL® by E. I. du Pont de Nemours and Company of Wilmington, Del. The HYTREL® product is a polyester thermoplastic elastomer with the friction, compressibility, and tensile properties conducive to forming the top layer of the multilayer creping belt described herein.

Thermoplastics, such as the polyurethanes described above, are advantageous materials for forming the top layer of the inventive multilayer belt when considering the ability to form openings of different sizes and configurations in thermoplastics. Openings in the thermoplastic used to form the top layer may be easily formed using a variety of techniques. Examples of such techniques include laser engraving, drilling, cutting or mechanical punching. As will be appreciated by those skilled in the art, such techniques can be used to form large and consistently-sized openings. In fact, openings of most any configuration (dimensions, shape, sidewall angle, etc.) can be formed in a thermoplastic top layer using such techniques.

The bottom layer of the multilayer creping belt functions to provide strength, MD stretch and creep resistance, CD stability, and durability to the belt. As discussed above, a flexible polymeric material, such as polyurethane, provides an attractive option for the top layer of the belt. Polyurethane, however, is a relatively weak material that, by itself, will not provide the desirable properties to the belt. A homogenous monolithic polyurethane belt would not be able to withstand the stresses and strains imparted to the belt during a papermaking process. By joining a polyurethane top layer with a second layer, however, the second layer can provide the required strength, stretch resistance, etc., to the belt. In essence, the use of a distinct bottom layer, separate from the top layer, expands the potential range of materials that can be used for the top layer.

As with the top layer, the bottom layer also includes a plurality of openings through the thickness of the layer. Each opening in the bottom layer is aligned with at least one opening in the top layer, and thus, openings are provided through the thickness of the multilayer belt, i.e., through the top and bottom layers. The openings in the bottom layer, however, are smaller than the openings in the top layer. That is, the openings in the bottom layer have a smaller cross-sectional area adjacent to the interface between the top layer and the bottom layer than the cross-sectional area of the plurality of openings of the top layer adjacent to the interface between the top and bottom layers. The openings in the bottom layer, therefore, can prevent cellulosic fibers from being pulled completely through the multilayer belt structure, for example, when the belt and papermaking web are exposed to a vacuum In some embodiments of the invention, a woven fabric is provided as the bottom layer of the multilayer creping belt. As discussed above, woven structuring fabrics have the strength and durability to withstand the forces of a creping operation. And, as such, woven structuring fabrics have been used, by themselves, as creping structures in papermaking processes. A woven structuring fabric, therefore, can provide the necessary strength, durability, and other properties for the multilayer creping belt according to the invention. In specific embodiments of the multilayer creping belt, the woven fabric provided for the bottom layer has similar characteristics to woven structuring fabrics used by themselves as creping structures. Such fabrics have a woven structure that, in effect, has a plurality of "openings" formed between the yarns making up the fabric structure. In this regard, the result of the openings in a fabric may be quantified as an air permeability that allows airflow through the fabric. In terms of our invention, the permeability of the fabric, in conjunction with the openings in the top layer, allows air to be drawn through the belt. Such airflow can be drawn through the belt at a vacuum box in the papermaking machine, as described above. Another aspect of the woven fabric layer is the ability to prevent fibers from being pulled completely through the multilayer belt at the vacuum box. In general, it is preferable that less than one percent of the fibers should pass completely through the creping belt or fabric during a papermaking process.

As an alternative to a woven fabric, in other embodiments of the invention, the bottom layer of the multilayer creping belt can be formed from an extruded thermoplastic material. Unlike the flexible thermoplastic materials used to form the top layer discussed above, however, the thermoplastic material used to form the bottom layer is provided in order to impart strength, stretch resistance, durability, etc., to the multilayer creping belt. Examples of thermoplastic materials that can be used to form the bottom layer include polyesters, copolyesters, polyamides, and copolyamides.

Figure 3A:
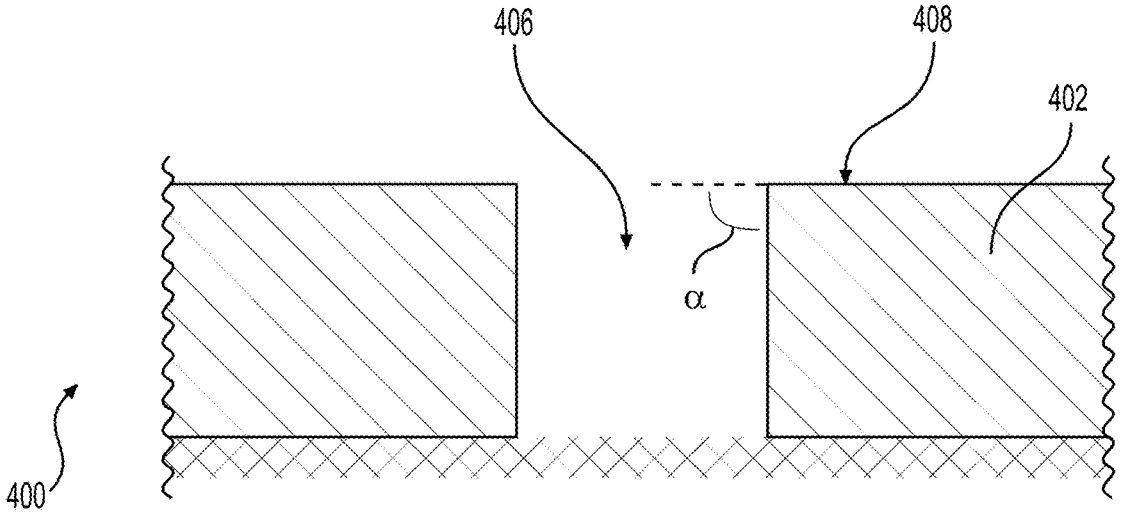
FIG. 3A is a cross-sectional view of a portion of a multilayer creping belt according to an embodiment of the invention.

FIG. 3A is a cross-sectional view of a portion of a multilayer creping belt 400 according to an embodiment of the invention. The creping belt 400 includes a polymeric top layer 402 and a woven fabric bottom layer 404. The polymeric top layer 402 provides the top surface 408 of the creping belt 400 on which the web is creped during the creping operation of the papermaking process. An opening 406 is formed in the polymeric top layer 402, as described above. Note that the opening 406 extends through the thickness of the polymeric top layer 402 from the top surface 408 to the surface facing the woven fabric bottom layer 404. As the woven fabric bottom layer 404 has a certain permeability, a vacuum can be applied to the woven fabric bottom layer 404 side of the creping belt 400, and, thus, draw an airflow through the opening 406 and the woven fabric bottom layer 404. During the creping operation using the creping belt 400, cellulosic fibers from the web are drawn into the opening 406 in the polymeric top layer 402, which will result in a dome structure being formed in the web (as will be described more fully below). A vacuum may additionally be used to draw the web into the opening 406.

Figure 3B:
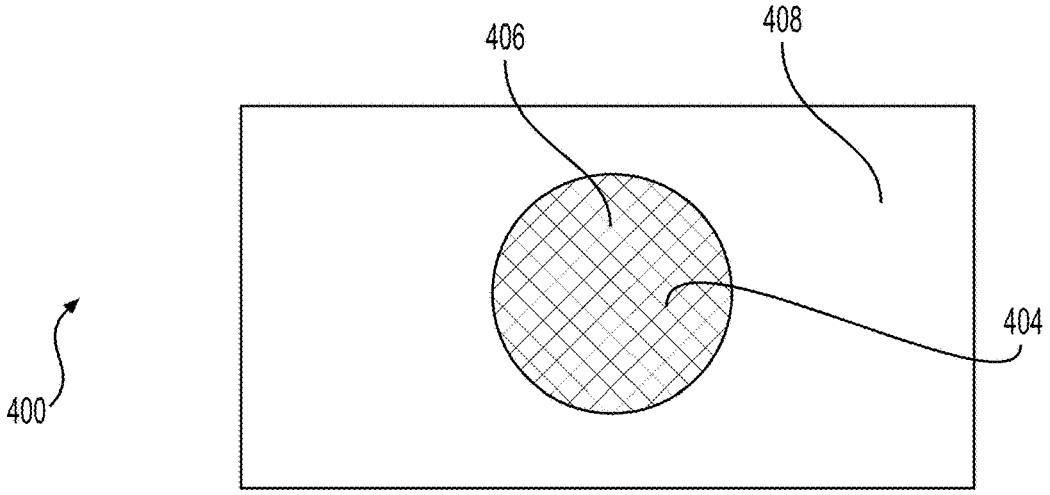
FIG. 3B is a top view of the portion of the multilayer creping belt shown in FIG. 3A.

FIG. 3B is a top view of the creping belt 400 looking down on the portion with the opening 406 shown in FIG. 3A. As is evident from FIGS. 3A and 3B, while the woven fabric bottom layer 404 allows the vacuum to be drawn through the creping belt 400, the woven fabric bottom layer 404 also effectively closes off the opening 406 in the top layer 402. That is, the woven fabric bottom layer 404 in effect provides a plurality of openings that have a smaller cross-sectional area adjacent to the interface between the polymeric top layer 402 and the woven fabric bottom layer 404. Thus, the woven fabric bottom layer 404 can substantially prevent cellulosic fibers from passing through the creping belt 400. As described above, the woven fabric bottom layer 404 also imparts strength, durability, and stability to the creping belt 400.

The layers of the multilayer creping belt 400 according to the invention may be joined together in any manner that provides a durable enough connection between the layers to allow the multilayer creping belt 400 to be used in a papermaking process. In some embodiments, the layers are joined together by a chemical means, such as using an adhesive. A specific example of an adhesive structure that could be used to join the layers is a double coated tape. In other embodiments, the layers may be joined together by a mechanical means, such as using a hook-and-loop fastener. In still other embodiments, the layers of the multilayer belt may be joined by techniques such as heat welding and laser fusion. Those skilled in the art will appreciate the numerous lamination techniques that could be used to join the layers described herein to form the multilayer creping belt 400.

Figure 4A:
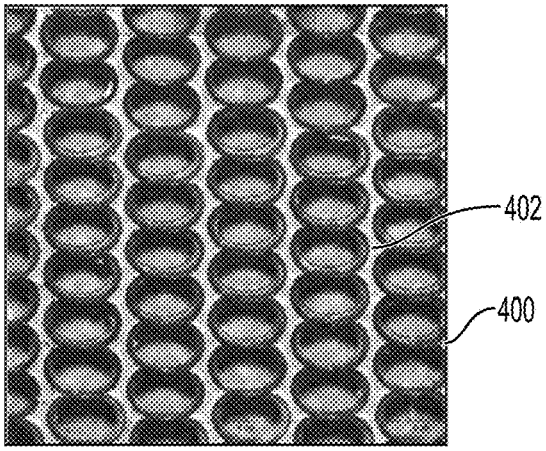
FIG. 4A is a view of a portion of the top surface of a creping belt according to an embodiment of the invention.
Figure 4B:
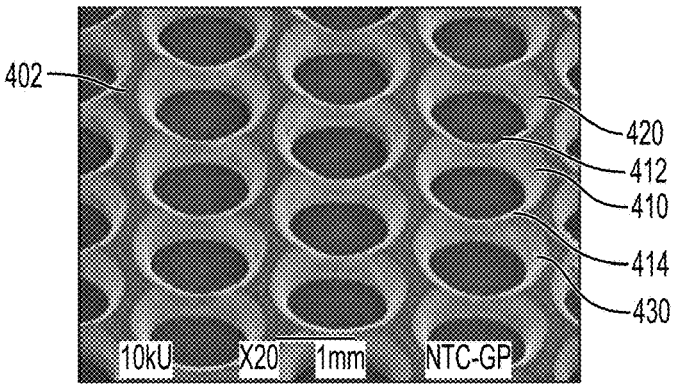
FIG. 4B is an elevation view of a portion of the top surface of the creping belt shown in FIG. 4A.
Figure 4C:
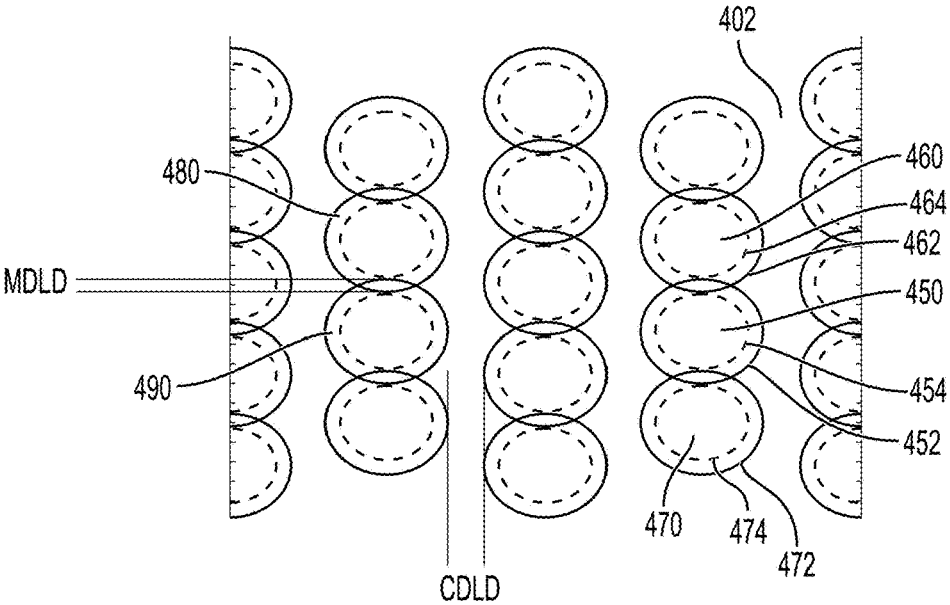
FIG. 4C is a schematic diagram showing the layout of the openings in the creping belt shown in FIG. 4A.

FIGS. 4A-4C show the arrangement of openings 406 in the top layer 402 of a multilayer creping belt 400 according to an embodiment of our invention. In these figures, the MD is shown towards the top of the page. As shown in the figures, the openings 406 are substantially arranged in parallel lines running in the MD of the belt. Between the lines of openings 406 are substantially parallel lines of a contact surface of the polymeric top layer 402. The openings 406 in each MD line are positioned so closely together that there is an "overlap" in each of the openings. When referring herein to openings that "overlap," we mean that the openings 406 are positioned so closely together that the area an opening along the top layer 402 that would have been formed if the opening had been spaced from other all other openings on the surface of the creping belt 400 in fact overlaps with the area of another of the openings because of the close positioning of the openings. For example, in schematic representation shown in FIG. 4C, the area of the opening 450 as formed by laser drilling in the top layer 402 is shown by the solid line 452. The areas of adjacent openings 460 and 470 on the top layer 402 are shown by solid lines 462 and 472, respectively. The areas of the openings 450, 460, and 470 along the bottom surface are shown by the dotted lines 454, 464, and 474, respectively. The area of the opening 450 at the top layer 402 denoted by the solid line 452 overlaps with the areas of openings 460 and 470 denoted by solid lines 462 and 472, respectively. The overlap distance between edges of openings 480 and 490 is denoted as OD in FIG. 4C.

As can be seen in FIG. 4B, as a result of the overlapping areas of the openings, the top edge of each of the openings includes portions that are common with the top edges of adjacent openings. For example, the top edge of the opening 410 includes a portion 412 that is also a portion of the top edge of the adjacent opening 420. The top edge of the opening 410 also includes another portion 414 that is also a portion of the top edge of the adjacent opening 430.

As can also be seen in FIG. 4B, the inside surfaces of the openings are angled from the top edges on the top layer 402 to the bottom edges of the openings on the bottom surface of the top layer 402. That is, the inside surfaces of the openings are angled inward relative to the top edge. As a result, the areas of the openings at the top layer 402 are larger than the areas of the openings in the bottom surface of the top layer 402. Also, as a result of the combination of the shapes of the openings, the overlap in the openings, and the angled inside surfaces of the openings, the portions of the top edges of the openings that are common between two openings lie below the plane of the top layer 402. For example, the shared edge portion 412 of the openings 410 and 420 undulates down from the separate edge portions of the openings 410 and 420 to a lowest point at the center of the shared edge portion 412. Because of the undulation in the common portions of the edges below the top layer 402 of the creping belt 400, each of the openings is in essence "connected" with other openings in that there is an open space between the openings below the plane of the top layer 402. As will be discussed more fully below, as a result of the connection between openings, the domes formed in paper products made using such connected openings are also connected, which results in paper products having surprisingly good properties as compared to paper products made using belts wherein the openings in the top layer are separated from each other.

In the embodiment shown in FIGS. 4A and 4B, the openings are arranged in substantially straight lines running in the MD of the belt. However, our invention is not limited to such a configuration. For example, FIGS. 5A and 5B are schematic diagrams of connected openings in multilayer belts according to further embodiments of our invention, wherein the openings do not run in straight lines.

Figure 5A:
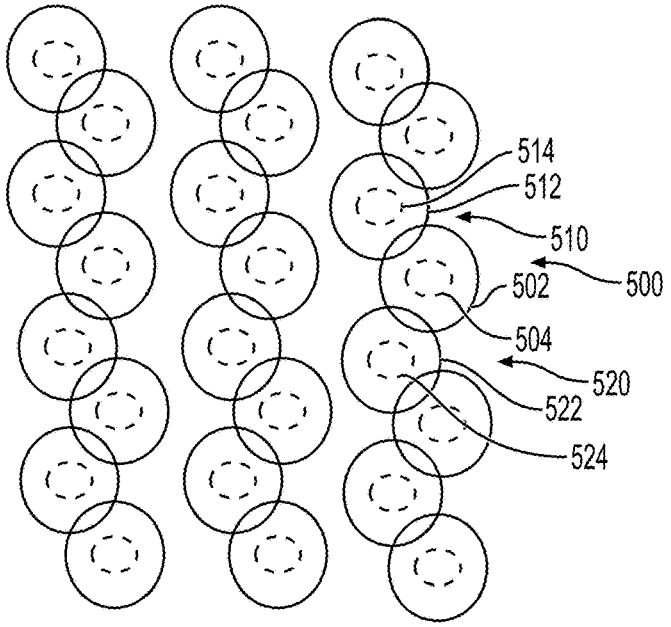
FIGS. 5A and 5B are schematic diagrams showing the layout of openings in the top surface of creping belts according to further embodiments of the invention.

In the embodiment shown in FIG. 5A, the openings are staggered such that each opening is offset in the CD from the two adjacent, connected openings. For example, the opening 500 is positioned in the CD such that the edge 502 of the opening 500 in the top surface of the top layer of the belt is offset in the CD from the edges 512 and 522 of the adjacent, connected openings 510 and 520 (the edges 504, 514, 524 of the openings 500, 510, and 520 in the bottom surface of the top layer are also offset in the CD). Thus, while lines of connected openings extend in the MD of the belt, the lines of openings are not straight. It should be noted that while three lines of openings running in the MD are shown in the schematic representation of FIG. 5A, a belt according to our invention may include many additional lines along the CD length of the belt.

Figure 5B:
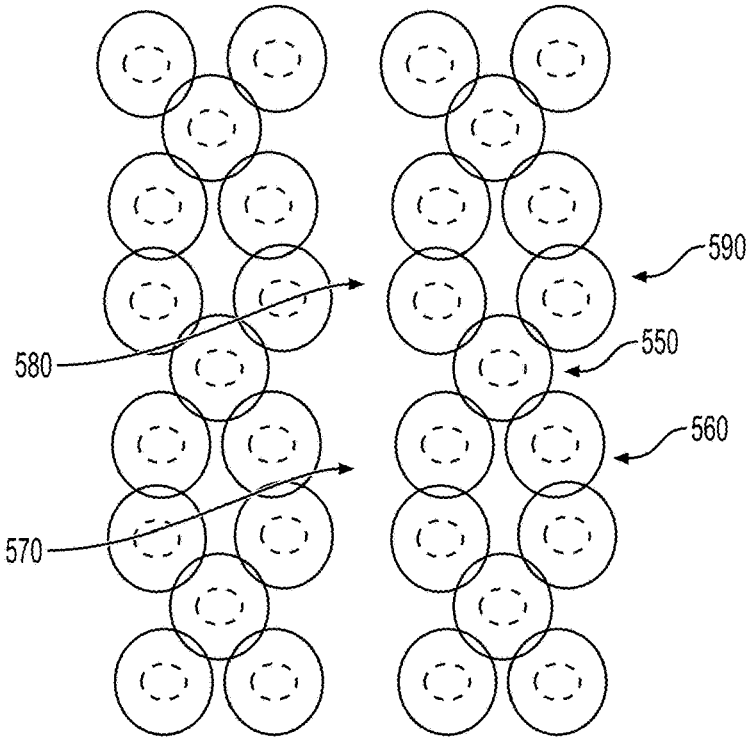

FIG. 5B is a schematic representation of a further alternative positioning of openings in the top lay of a creping belt according to an embodiment of our invention. In this embodiment, there is a repeating pattern of five overlapping openings. For example, the opening 550 overlaps (and, thus, is connected) with openings 560, 570, 580, and 590. This pattern of overlapping openings repeats such that lines of connected openings are formed in the MD. Two such lines are shown in FIG. 5B, though a belt according to our invention may include many additional lines along the CD length of the belt.

Those skilled in the art will recognize many alternative positions of openings that, while being different from the exact patterns shown in FIGS. 4A-5B, would similarly result in lines of connected openings running in the MD. It follows that our invention should not be construed as limited to any of the specific patterns of openings depicted herein.

Figure 6:
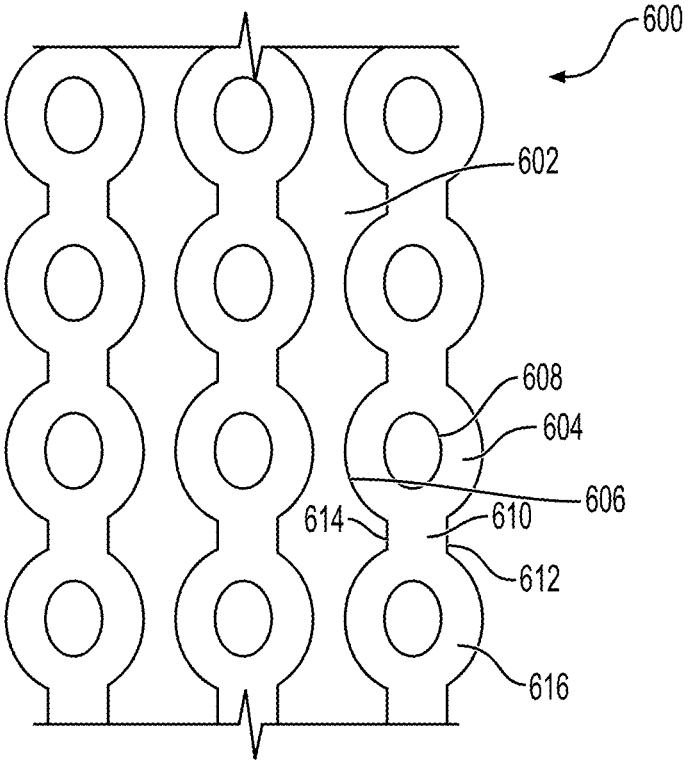
FIG. 6 is a view of a top surface of a creping belt according to a further embodiment of the invention.

FIG. 6 is view of a portion of a top surface 602 of a multilayer creping belt 600 according to yet another embodiment of our invention. In this case, the openings in the top layer do not overlap, but the openings are nevertheless connected. For example, the opening 604 includes edges 606 in the top surface 602 and an edge 608 in the bottom surface of the top layer. Adjacent to the opening 604 is a trench 610 formed into the top surface 602 of the creping belt 600. The trench 610 extends a depth into the top layer, but not all the way through the top layer to the bottom surface. The trench 610 runs from the edges 606 of the opening 604 to edges of another opening 616 that is generally aligned with the opening 604 in the CD. As such, the opening 604 and the opening 616 are connected by the trench 610—the trench 610 forming an open space between the openings 604 and 616 below the plane of the top surface 602 of the creping belt 600. The trench 610 has edges 612 and 614. With the configuration of openings shown in FIG. 6, lines of connected openings are formed in the MD even though the openings do not overlap.

As will be appreciated by those skilled in the art, while the portions of the top layer of belts shown in FIGS. 4A-6 may form the vast majority of the pattern of openings in the top layer, the belts according to our invention might include other portions that are different from the depicted portions. For example, the openings in the top layer of a multilayer belt could be formed with a "stamp" having the pattern as shown in FIGS. 5A and 5B. While such a stamp would be repeated over the area of the belt, between each stamping there might be a break where no openings are formed. Or, as another example, between each stamp there might a different pattern of openings formed in the top layer. Regardless of such breaks in stamp pattern, the results of our invention (as described in detail below) will still be achieved.

When considering the different configurations of the openings that can be formed in the top layer, it is important to note that the openings need not be identically shaped to any of the shapes shown herein. That is, some of the openings formed in the top layer can have different configurations from other openings that are formed in the top layer. In fact, different openings could be provided in the top layer in order to provide different functions in the paper making process. For example, some of the openings in the top layer could be sized and shaped to provide for forming dome structures in the papermaking web during the creping operation (described in detail below). At the same time, other openings in the top layer could be of a much greater size and a varying shape so as to provide patterns in the papermaking web that are equivalent to patterns that are achieved with an embossing operation. The ability to produce an embossing effect with the belt is highly advantageous because this may reduce or eliminate the undesirable effects of an actual embossing process, such as loss in sheet bulk and other desired properties.

When considering the size of the openings for forming dome structures in the papermaking web in a creping operation, the top layer of the inventive multilayer belt allows for much larger sizes than alternative structures, such as woven structuring fabrics and monolithic polymeric belt structures. The size of the openings may be quantified in terms of the cross-sectional area of the openings in the plane of the surface of the multilayer belt provided by the top layer. In some embodiments, the openings in the top layer of a multilayer belt have an average cross-sectional area on the forming (top) surface of at least about 1.0 $mm^2$. More specifically, the openings have an average cross-sectional area from about 1.0 $mm^2$ to about 15 $mm^2$, or still more specifically, about 1.5 $mm^2$ to about 8.0 $mm^2$, or even more specifically, about 2.1 $mm^2$ to about 7.1 $mm^2$. As will be readily appreciated by those skilled in the art, it would be extremely difficult, if not impossible or impractical, to form a monolithic belt having openings with the cross-sectional areas of the multilayer belt according to the invention. For example, openings of these sizes would require the removal of the bulk of the material forming the monolithic belt such that the belt would likely not be durable enough to withstand the rigors and stresses of a papermaking belt creping process. As will also be readily appreciated by those skilled in the art, a woven structuring fabric could likely not be provided with the equivalent to these size openings, as the yarns of the fabric could not be woven (spaced apart or size) to provide such an equivalent to the openings, and yet still provide enough structural integrity to be able to function in a papermaking process.

The size of the openings may also be quantified in terms of volume. Herein, the volume of an opening refers to the space that the opening occupies through the thickness of the belt. The openings in the top layer of a multilayer belt according to the invention may have a volume of at least about 0.2 $mm^3$. More specifically, the volume of the openings may range from about 0.5 $mm^3$ to about 23 $mm^3$, or more specifically, the volume of the openings ranges from 0.5 $mm^3$ to about 11 $mm^3$.

TABLES 1 and 2 show specific configurations and properties of multilayer belts having connected openings in the top layer according to embodiments of our invention. These belts include a polymeric top layer and a fabric or polymeric bottom layer, as described above. TABLES 1 and 2 set forth properties of the openings in the top layer (i.e., the "sheet side") of each belt, such as the cross-sectional areas, volumes of the openings, and angles of the sidewalls of the openings. TABLES 1 and 2 also set forth properties of the openings in the bottom layer (i.e., the "air side"). The openings in embodiments of the belts set forth in TABLES 1 and 2 are aligned in substantially straight lines in the MD, as shown in FIGS. 4A-4C. The overlap in the openings can be seen from the MD land distance property set forth in TABLES 1 and 2. That is, MD land distance ("MDLD") indicates the distance on the top surface of the top layer between the edges of two adjacent openings in the MD direction. Thus, the negative values for the MD land distance in TABLES 1 and 2 are indicative in the overlap distance in the edges in the way that the edges of openings 480 and 490 overlap a distance MDLD in FIG. 4C. Also, the CD land distance ("CDLD") indicates the distance on the top surface between the edges of the in two parallel lines, as shown, for example, as CDLD in FIG. 4C.

TABLE 1

| Property | BELT 1 | BELT 2 | BELT 3 | BELT 4 | BELT 5 | BELT 6 | BELT 7 | BELT 8 | BELT 9 | BELT 10 |
|---|---|---|---|---|---|---|---|---|---|---|
| Sheet Side Hole CD Diameter (mm) | 1.67 | 1.54 | 1.37 | 1.48 | 1.59 | 1.56 | 1.40 | 1.65 | 1.65 | 1.59 |
| Sheet Side Hole MD Diameter (mm) | 1.09 | 1.22 | 1.09 | 1.19 | 1.19 | 0.87 | 1.14 | 1.35 | 1.35 | 1.09 |
| Sheet Side Hole CD/MD | 1.5 | 1.3 | 1.3 | 1.2 | 1.3 | 1.8 | 1.2 | 1.2 | 1.2 | 1.5 |
| Sheet Side Hole Cross-Sectional Area ($mm^2$) | 1.44 | 1.47 | 1.18 | 1.38 | 1.40 | 1.066 | 1.25 | 1.75 | 1.75 | 1.36 |
| Sheet Side Hole % Open Area | 77.3 | 75.2 | 66.2 | 69.1 | 70.7 | 81.0 | 73.4 | 69.1 | 69.2 | 73.0 |
| Air Side Hole CD Diameter (mm) | 1.26 | 1.02 | 0.95 | 1.07 | 0.97 | 1.18 | 1.22 | 1.26 | 1.26 | 1.18 |
| Air Side Hole MD Diameter (mm) | 0.75 | 0.71 | 0.66 | 0.70 | 0.72 | 0.48 | 0.97 | 0.86 | 0.86 | 0.67 |
| Air Side Hole CD/MD | 1.68 | 1.43 | 1.43 | 1.54 | 1.33 | 2.44 | 1.26 | 1.46 | 1.46 | 1.76 |
| Air Side Hole Cross-Sectional Area ($mm^2$) | 0.741 | 0.57 | 0.49 | 0.59 | 0.55 | 0.447 | 0.92 | 0.85 | 0.85 | 0.62 |
| Air Side Hole % Open Area | 39.9 | 29.1 | 27.8 | 29.2 | 27.7 | 34.0 | 54.1 | 33.8 | 33.8 | 33.2 |
| Sheet Side/Air Side Area Ratio | 1.9 | 2.6 | 2.4 | 2.4 | 2.5 | 2.4 | 1.4 | 2.0 | 2.0 | 2.2 |
| Side Wall Angle CD 1 (deg) | 78.3 | 75 | 78 | 78.4 | 75 | 79.1 | 84.9 | 78.9 | 78.9 | 78.4 |
| Side Wall Angle CD 2 (deg) | 78.3 | 75 | 78 | 78.4 | 75 | 79.1 | 84.9 | 78.9 | 78.9 | 78.4 |
| Side Wall Angle MD 1 (deg) | 80.3 | 76 | 78 | 76.2 | 77 | 79.1 | 84.9 | 76.4 | 76.4 | 78.1 |
| Side Wall Angle MD 2 (deg) | 80.3 | 76 | 78 | 76.2 | 77 | 79.1 | 84.9 | 76.4 | 76.4 | 78.1 |
| Volume of Openings in Top Layer ($mm^3$) | 1.07 | 0.98 | 0.81 | 0.96 | 0.94 | 0.73 | 1.08 | 1.28 | 1.28 | 0.968 |
| % Material Removed From Top Layer | 57.6 | 50.3 | 45.6 | 47.8 | 47.5 | 55.8 | 63.5 | 50.4 | 50.5 | 51.8 |
| MD Land Distance (mm) | −0.06 | −0.05 | −0.04 | −0.03 | 0.12 | −0.07 | −0.02 | −0.16 | −0.26 | −0.14 |
| MD Land/MD Diameter Ratio (%) | −5.9 | −4.4 | −4.1 | −2.2 | −9.8 | −8.1% | −1.19 | −11.7 | −19.6 | −12.4 |
| CD Land Distance | 1.94 | 1.82 | 2.02 | 1.96 | 2.19 | 1.73 | 1.65 | 2.60 | 3.01 | 2.32 |
| CD Land/CD Dia. Ratio % | 116.16 | 118.64 | 147.57 | 132.34 | 146.35 | 110.90 | 118.01 | 157.27 | 182.29 | 145.76 |
| 1/width (columns/cm) | 2.76 | 2.98 | 2.94 | 2.90 | 2.71 | 3.04 | 3.28 | 2.35 | 2.15 | 2.56 |
| 1/height (rows/cm) | 19.47 | 17.20 | 19.10 | 17.20 | 18.65 | 25.04 | 17.83 | 16.79 | 18.44 | 20.91 |
| Holes per $cm^2$ | 54 | 51 | 56 | 50 | 51 | 76 | 59 | 40 | 40 | 54 |
| Belt Thickness (mm) | 1.00 | 1.00 | 1.00 | 1.00 | 1.00 | 1.00 | 1.00 | 1.00 | 1.00 | 1.00 |

TABLE 2

| Property | BELT 11 | BELT 12 | BELT 13 | BELT 14 | BELT 15 | BELT 16 | BELT 17 | BELT 18 | BELT 19 |
|---|---|---|---|---|---|---|---|---|---|
| Sheet Side Hole CD Diameter (mm) | 1.45 | 1.45 | 1.45 | 1.35 | 1.35 | 1.35 | 1.35 | 1.35 | 1.40 |
| Sheet Side Hole MD Diameter (mm) | 1.14 | 1.22 | 1.22 | 1.16 | 1.16 | 1.16 | 1.16 | 1.35 | 1.27 |
| Sheet Side Hole CD/MD | 1.3 | 1.2 | 1.2 | 1.2 | 1.2 | 1.2 | 1.2 | 1.0 | 1.1 |
| Sheet Side Hole Cross-Sectional Area ($mm^2$) | 1.29 | 1.38 | 1.38 | 1.23 | 1.23 | 1.23 | 1.23 | 1.42 | 1.39 |
| Sheet Side Hole % Open Area | 71.6 | 76.7 | 70.1 | 76.1 | 70.0 | 65.1 | 75.4 | 66.4 | 70.0 |
| Air Side Hole CD Diameter (mm) | 0.99 | 1.02 | 1.02 | 0.94 | 0.94 | 0.94 | 0.94 | 0.94 | 0.91 |
| Air Side Hole MD Diameter (mm) | 0.70 | 0.78 | 0.78 | 0.76 | 0.76 | 0.76 | 0.76 | 0.94 | 0.80 |
| Air Side Hole CD/MD | 1.42 | 1.31 | 1.31 | 1.24 | 1.24 | 1.24 | 1.24 | 1.01 | 1.14 |
| Air Side Hole Cross-Sectional Area ($mm^2$) | 0.54 | 0.62 | 0.62 | 0.56 | 0.56 | 0.56 | 0.56 | 0.69 | 0.57 |
| Air Side Hole % Open Area | 30.0 | 34.5 | 31.5 | 34.7 | 32.0 | 29.7 | 34.4 | 32.3 | 28.9 |
| Sheet Side/Air Side Area Ratio | 2.4 | 2.2 | 2.2 | 2.2 | 2.2 | 2.2 | 2.2 | 2.1 | 2.4 |
| Side Wall Angle CD 1 (deg) | 77.1 | 77.9 | 77.9 | 78.6 | 78.6 | 78.6 | 78.6 | 78.6 | 76.4 |
| Side Wall Angle CD 2 (deg) | 77.1 | 77.9 | 77.9 | 78.6 | 78.6 | 78.6 | 78.6 | 78.6 | 76.4 |
| Side Wall Angle MD 1 (deg) | 77.6 | 77.6 | 77.6 | 78.6 | 78.6 | 78.6 | 78.6 | 78.4 | 76.8 |

TABLE 2-continued

| Property | BELT 11 | BELT 12 | BELT 13 | BELT 14 | BELT 15 | BELT 16 | BELT 17 | BELT 18 | BELT 19 |
|---|---|---|---|---|---|---|---|---|---|
| Side Wall Angle MD 2 (deg) | 77.6 | 77.6 | 77.6 | 78.6 | 78.6 | 78.6 | 78.6 | 78.4 | 76.8 |
| Volume of Openings in Top Layer ($mm^3$) | 0.890 | 0.978 | 0.978 | 0.872 | 0.872 | 0.872 | 0.872 | 1.037 | 0.95 |
| % Material Removed From Top Layer | 49.3 | 54.2 | 49.5 | 54.1 | 49.8 | 46.3 | 53.6 | 48.3 | 48.0 |
| MD Land Distance (mm) | −0.06 | −0.14 | −0.14 | −0.09 | −0.09 | −0.09 | −0.23 | −0.13 | −0.21 |
| MD Land/MD Diameter Ratio (%) | −5.5 | −11.8 | −11.8 | −7.6 | −7.6 | −7.6 | −20.1% | −9.3 | −16/5 |
| CD Land Distance | 1.92 | 1.92 | 2.23 | 1.66 | 1.92 | 2.17 | 2.17 | 2.17 | 2.35 |
| CD Land/CD Dia. Ratio % | 132.37 | 132.37 | 154.26 | 123.29 | 142.83 | 160.97 | 160.97 | 160.97 | 168.56 |
| 1/width (columns/cm) | 2.97 | 2.97 | 2.72 | 3.33 | 3.06 | 2.85 | 2.85 | 2.85 | 2.67 |
| 1/height (rows/cm) | 18.65 | 18.65 | 18.65 | 18.65 | 18.65 | 18.65 | 21.57 | 16.38 | 18.85 |
| Holes per $cm^2$ | 55 | 55 | 51 | 62 | 57 | 53 | 61 | 47 | 50 |
| Belt Thickness (mm) | 1.00 | 1.00 | 1.00 | 1.00 | 1.00 | 1.00 | 1.00 | 1.00 | 1.00 |

Processes

Other aspects of our invention are directed to processes of making paper products. The processes can utilize the multilayer belt described herein for a creping operation. In such processes, any of the papermaking machines of the general types described above may be used. Of course, those skilled in the art will recognize the numerous variations and alternative configurations of papermaking machines that can be utilized for performing the inventive processes described herein. Moreover, those skilled in the art will recognize that the well-known variables and parameters that are a part of any papermaking process can be readily determined and used in conjunction with the inventive processes, e.g., the particular type of furnish for forming the web in the papermaking process can be selected based on desired characteristics of the product.

In some processes according to the invention, the web is at a consistency (i.e., solids content) between about 15 to about 25 percent when deposited on the creping belt. In other processes according to the invention, belt creping occurs under pressure in a creping nip while the web is at a consistency between about 30 to about 60 percent. In such processes, a papermaking machine may have, for example, the configuration shown in FIG. 1 and described above. Details of such a process can be found in the aforementioned U.S. Patent Application Pub. No. 2010/0186913. In this process, the web consistency, a velocity delta occurring at the belt-creping nip, the pressure employed at the creping nip, and the belt and nip geometry act to rearrange the fiber while the web is still pliable enough to undergo structural change. Without intending to be bound by theory, it is believed that the slower forming surface speed of the creping belt causes the web to be substantially molded into openings in the creping belt, with the fibers being realigned in proportion to the creping ratio. Some of the fibers are moved to the CD orientation, while other fibers are folded to MD ribbons. As a result of this creping operation, high caliper sheets can be formed. The multilayer belt described herein is well-suited for these processes. In particular, as described above, the multilayer belt may be configured so that the openings have a wide range of sizes, and thus, can effectively be used with these processes.

A further aspect of processes according to the invention is the application of a vacuum to the multilayer creping belt. As described above, a vacuum may be applied as the web is deposited on the creping belt in a paper making process. The vacuum acts to draw the web into the openings in the creping belt, that is, the openings in the top layer in the multilayer belt according to the invention. Notably, in processes both with and without the use of a vacuum, the web is drawn into the plurality of openings in the top layer of the multilayer belt structure, but the web is not drawn into the bottom layer of the multilayer belt structure. In some of the embodiments of the invention, the applied vacuum is about 5 in. Hg to about 30 in. Hg. As described in detail above, the bottom layer of the multilayer belt acts as a sieve to prevent fibers from being pulled through the belt structure. This bottom layer sieve functionality is particularly important when a vacuum is applied, as fibers are prevented from being pulled through to the structure that creates the vacuum, i.e., the vacuum box.

Paper Products

Other aspects of our invention are novel paper products that are not capable of being produced using previously-known papermaking machines and processes known in the art. In particular, the multilayer belts with connected openings described herein allow for the formation of paper products that demonstrate superior properties and characteristics that have not been previously found in paper products made with known papermaking machines and papermaking processes.

It should be noted that the paper products referred to herein encompass all grades of products. That is, some embodiments of the invention are directed to tissue grade products, which, in general, have a basis weight of less than about 27 lbs/ream and a caliper of less than about 180 mils/8 sheets. Other embodiments of the invention are directed to towel grade products, which, in general, have a basis weight of greater than about 35 lbs/ream and a caliper of greater than about 225 mils/8 sheets.

Sensory softness is a measure of the perceived softness of a paper product as determined by trained evaluators using standardized testing techniques. That is, sensory softness is measured by evaluators experienced with determining the softness, with the evaluators following specific techniques for grasping the paper and ascertaining a perceived softness of the paper. The higher the sensory softness number, the higher the perceived softness.

To demonstrate this combination of properties, products were made using belts with the configuration of the BELTS 1 through 3 shown in TABLE 1. In these trials, two-ply tissue grade products were ultimately formed, as indicated below.

For BELT 1, the trials were conducted using the operating conditions shown on a papermaking machine similar to the machine shown in FIG. 1. For these trials, a papermaking furnish was used in a homogeneous mode. A caliper of 75 mils/8 sheets was targeted. A total of 1.25 lb/ton of debonder was added in the airside stock and no debonder was added in the Yankee-side stock. To ensure adequate Yankee adhesion, KL506 PVOH was used as part of the Yankee coating adhesive. The target basesheet caliper was achieved by generating the highest possible uncalendered caliper, and then calendering the result to be 125 mils/8-ply. A 550 g/in$^3$ CD wet tensile was achieved by balancing refining and add-ons of wet strength and carboxymethyl cellulose (CMC). The initial refining setting was 45 HP with the initial usages of wet strength resin and CMC at 25 and 5 lb/ton, respectively. Note, northern softwood kraft (NSWK), softwood kraft (SWK), wet strength resin (WSR), carboxymethyl cellulose (CMC), and polyvinyl alcohol (PVOH) may be abbreviated as indicated.

The caliper of basesheets made in the four trial runs with BELT 1 are shown in TABLE 3. Note, each of the trial runs was collected on two reels, as indicated.

TABLE 3

| Trial/Reel | 1/1 | 1/2 | 2/1 | 2/2 | 3/1 | 3/2 | 4/1 | 4/2 |
|---|---|---|---|---|---|---|---|---|
| Caliper (mils/8 sheets) | 69.8 | 72.5 | 83.3 | 80.9 | 80.7 | 80.0 | 73.2 | 71.6 |

The basesheets from the trials in TABLE 3 were then converted. TABLE 4 shows the properties of the converted basesheets.

TABLE 4

| Trial/Reel | 1/1 | 1/2 | 2/1 | 2/2 | 3/1 | 3/2 | 4/1 | 4/2 |
|---|---|---|---|---|---|---|---|---|
| Caliper (mils/8 sheets) | 69.8 | 72.5 | 83.3 | 79.6 | 80.7 | 77.7 | 73.2 | 72.1 |
| Basis Weight (lbs/ream) | 12.2 | 12.1 | 12.7 | 12.6 | 12.9 | 12.6 | 12.7 | 12.7 |
| MD Tensile (g/3 in.) | 512 | 538 | 549 | 515 | 666 | 666 | 609 | 557 |
| MD Stretch (%) | 29.6 | 30.3 | 33.7 | 30.9 | 31.9 | 30.3 | 29.2 | 30.8 |
| CD Tensile (g/ 3 in.) | 227 | 229 | 249 | 231 | 284 | 332 | 275 | 285 |
| CD Stretch (%) | 13.1 | 13.9 | 13.7 | 13.9 | 13.8 | 12.5 | 12.2 | 11.7 |
| MD/CD Stretch Ratio | 2.3 | 2.2 | 2.5 | 2.2 | 2.3 | 2.4 | 2.4 | 2.6 |
| CD Wet Tensile (g/in$^3$) | 26.8 | 24.0 | 27.7 | 26.7 | 29.9 | 35.2 | 30.6 | 30.0 |
| GM Tensile (g/3 in.) | 341 | 351 | 370 | 345 | 434 | 470 | 409 | 398 |
| Total Tensile (g/3 in.) | 739 | 767 | 798 | 746 | 949 | 938 | 884 | 842 |
| Wet/Dry (?) | 0.12 | 0.10 | 0.11 | 0.12 | 0.11 | 0.11 | 0.11 | 0.11 |
| Break Modulus GM (g/%) | 18.14 | 17.32 | 17.48 | 16.49 | 21.00 | 24.58 | 21.73 | 21.51 |

The converted basesheets shown in TABLE 4 were then made into final two-ply products. The dry burst properties of the final products are shown in TABLE 5.

TABLE 5

| | Trial/Reel | | | |
|---|---|---|---|---|
| | 1 | 2 | 3 | 4 |
| Dry Burst (lbf) (per TAPPI T-570) | 0.484 | 0.551 | 0.526 | 0.448 |

As will be appreciated by those skilled in the art, the properties of the basesheets and final products shown in TABLES 3-5 are exceptional for tissue grade products. Of particular note, the CD stretch ranged from about 11.7 to about 13.9 for the converted basesheets, the stretch ratio ranged from about 2.2 to about 2.6 for the converted basesheets, and the break modulus ranged from about 16.49 to about 24.58 for the converted basesheets. The combination of a high CD stretch, a high MD/CD stretch ratio, and low break modulus results in soft, cloth-like products. That is, the combination of properties provides a highly desirable product that is soft to the touch and drapes in a user's hand. Along with this cloth-like property, the caliper of the products ensures that the products have good absorbency.

Also of note, the basesheets shown in TABLE 4 had a relatively low GM Tensile ranging from about 341 to about 470. This is advantageous from a manufacturing standpoint as lower GM Tensile basesheets are easier to manufacture. The low GM Tensile in the basesheets is not problematic in the final products as the two-ply configuration results in a sufficient GM Tensile, while the final products are still soft.

Also of note was the dry burst test in the final products shown in TABLE 5. As will be appreciated by those skilled in the art, dry burst is a measure of strength of a product. The values ranging from about 0.45 to about 0.55 lbf indicate the tissue grade strength of the final products.

Figure 7:
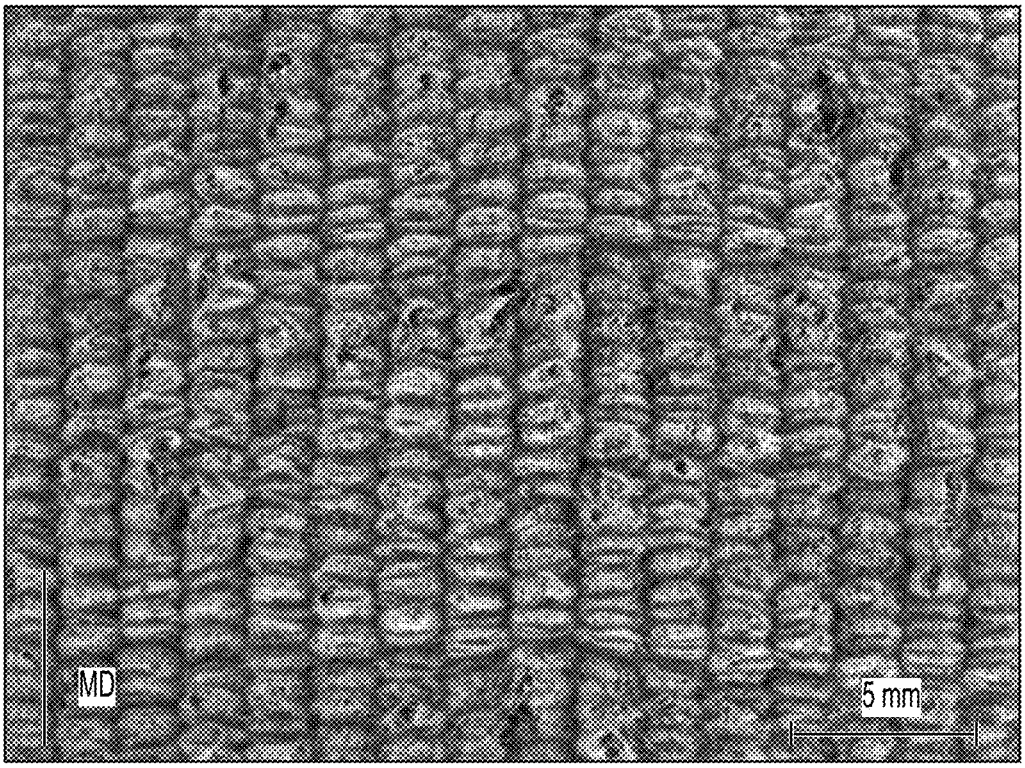
FIG. 7 is a micrograph (5×) of the air side of a basesheet according to an embodiment of our invention.
Figure 8:
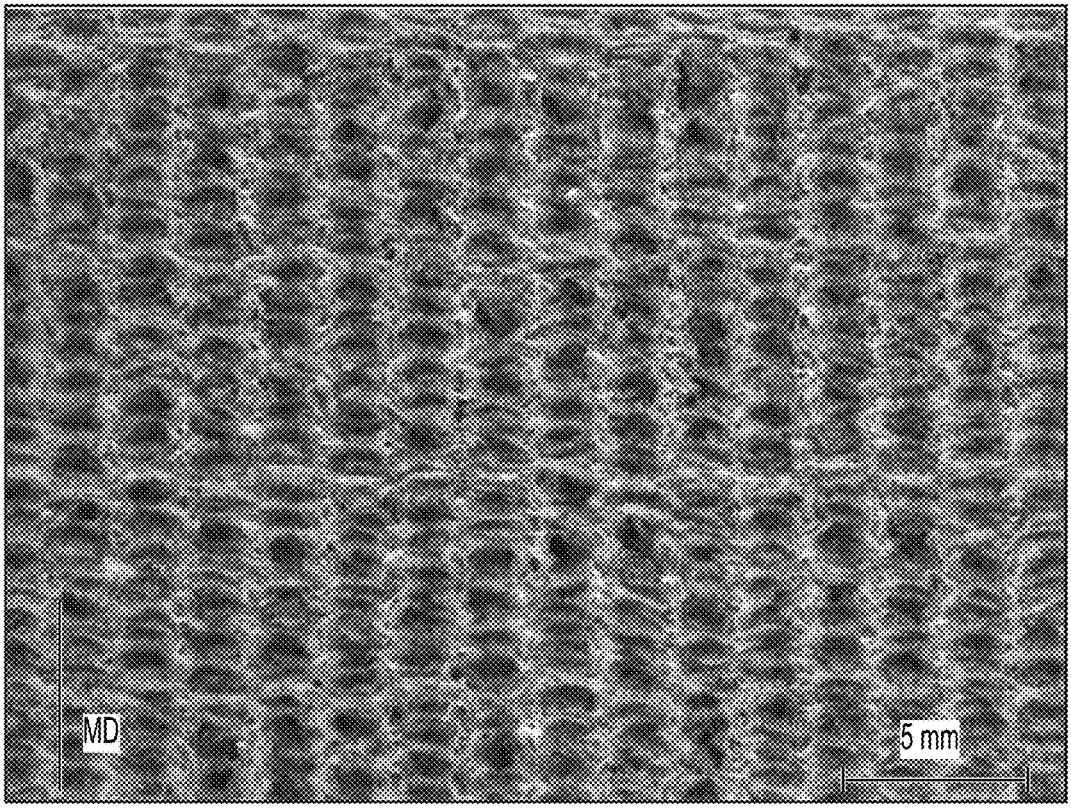
FIG. 8 is a micrograph (5×) of the Yankee side of the basesheet shown in FIG. 7.
Figure 9:
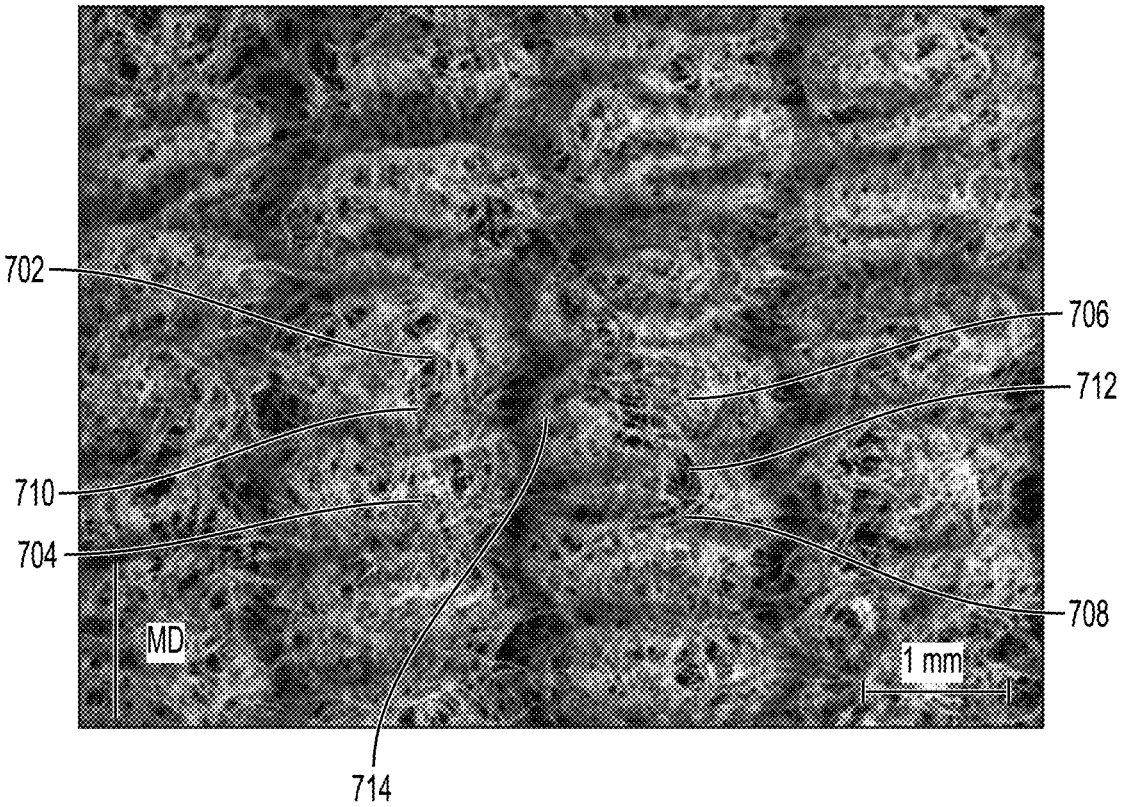
FIG. 9 is a micrograph (20×) of the basesheet shown in FIG. 7.

The outstanding properties seen in the basesheets and products shown in TABLES 3-5 are believed to stem from the configuration of the openings in BELT 1. As discussed above, the openings formed in top layer of a multilayer creping belt impart dome shapes to the web during a papermaking process with the belt. And, these dome shapes can be seen in the resulting products. For example, FIGS. 7-9 are micrographs of a basesheet formed in the trials with BELT 1. FIGS. 7 and 9 show the air side (i.e., the side of the basesheet formed against the belt), while FIG. 8 shows the Yankee side (i.e., the side of the basesheet that is not formed against the belt and transferred onto the surface of the Yankee dryer). In all of the figures the MD is shown in the vertical direction. The domes formed by the openings in the belt are clearly visible as the lighter regions in the figures, with four of the domes being labeled 702, 704, 706, and 708 in FIG. 9. Because of the connection (overlap) in the openings in the belt used to form the basesheet, the domes 702 and 704 are effectively merged together in a connection region 710, and domes 706 and 708 are effectively merged together in a connection region 712. Between the MD lines of domes are interconnecting regions, one which is labeled 714. The interconnecting regions correspond to portions of the basesheet that were formed on the contact surface of the top layer of the belt. Overall, the basesheet has parallel lines of connected domes running in the MD, with interconnected regions being formed between the MD lines of connected domes. Without being bound by theory, we believe that because of the parallel lines of connected domes running in the MD, the basesheet has a springy nature in the CD, that is, the structure of the basesheet in the CD is analogous to an accordion. At the same time, the interconnected lines between the MD lines of connected domes are believed to provide strength in the MD. As a result of the combination of springiness in the CD and strength in the MD, the basesheet and resulting product made from the basesheet exhibit outstanding CD stretch while still having a high stretch ratio (i.e., ratio of MD stretch to CD stretch).

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The apparatuses, processes, and products described herein can be used for the production of commercial paper products, such as toilet paper and paper towels. Thus, the apparatuses, processes, and products have numerous applications related to the paper product industry.

We claim:

1. An absorbent sheet having a machine direction (MD) of travel and a cross machine direction (CD) crossing the machine direction, the absorbent sheet comprising:

(a) a plurality of hollow domed regions projecting from a side of the absorbent sheet; and (b) connecting regions forming a network interconnecting the hollow domed regions of the absorbent sheet, wherein the absorbent sheet has parallel lines of connected domes running in the MD, with interconnected connecting regions being formed between the MD lines of connected domes such that each hollow domed region of the plurality of hollow domed regions merges with another hollow domed region in a respective interconnecting connecting region.

2. The absorbent sheet according to claim 1, wherein the absorbent sheet has a dry burst of about 0.45 lbf to about 0.55 lbf, indicative of tissue grade strength.

3. The absorbent sheet according to claim 1, wherein the absorbent sheet is a tissue grade product having a basis weight of less than about 27 lbs/ream and a caliper of less than about 180 mils/8 sheets.

4. The absorbent sheet according to claim 1, wherein the absorbent sheet is a towel grade product having a basis weight of greater than about 35 lbs/ream and a caliper of greater than about 225 mils/8 sheets.

5. The absorbent sheet according to claim 1, wherein the absorbent sheet has a CD stretch ranging from about 11.7 to about 13.9.

6. The absorbent sheet according to claim 1, wherein the absorbent sheet has a stretch ratio ranging from about 2.2 to 2.6.

7. The absorbent sheet according to claim 1, wherein the absorbent sheet has a break modulus ranging from about 16.49 to 24.58.

8. The absorbent sheet according to claim 1, wherein the absorbent sheet has a geometric mean (GM) tensile ranging from about 341 to about 470.

9. The absorbent sheet according to claim 1, wherein the absorbent sheet has a dry burst of about 0.45 lbf to about 0.55 lbf.

* * * * *